US009285173B2

(12) United States Patent
Arino et al.

(10) Patent No.: US 9,285,173 B2
(45) Date of Patent: Mar. 15, 2016

(54) CONDENSER

(71) Applicant: KEIHIN THERMAL TECHNOLOGY CORPORATION, Oyama-shi (JP)

(72) Inventors: Kouta Arino, Oyama (JP); Teruyuki Nagafuji, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 0 days.

(21) Appl. No.: 13/936,209

(22) Filed: Jul. 8, 2013

(65) Prior Publication Data

US 2014/0014296 A1 Jan. 16, 2014

(30) Foreign Application Priority Data

Jul. 13, 2012 (JP) ..... 2012-157057

(51) Int. Cl.

| | |
|---|---|
| ***F25B 39/04*** | (2006.01) |
| ***F25B 43/00*** | (2006.01) |
| ***F28F 27/02*** | (2006.01) |
| ***F28F 9/02*** | (2006.01) |
| ***F28D 1/053*** | (2006.01) |

(52) U.S. Cl.

CPC ..... *F28F 27/02* (2013.01); *F25B 39/04* (2013.01); *F25B 43/003* (2013.01); *F28D 1/05375* (2013.01); *F28F 9/028* (2013.01); *F25B 2339/0441* (2013.01); *F25B 2339/0444* (2013.01)

(58) Field of Classification Search

CPC ..... F25B 39/04; F25B 2339/0441; F25B 2339/0446; F25B 2339/044; F25B 43/00; F25B 43/003; F28F 1/126; F28F 9/026; F28F 9/028; F28F 9/0265; F28F 27/02; F28D 1/05316–1/05341; F28D 1/05366–1/05391; F28D 2021/0091–2021/0096

USPC ..... 165/132, 119, 173; 62/509

See application file for complete search history.

(56) References Cited

U.S. PATENT DOCUMENTS

| | | | | |
|---|---|---|---|---|
| 5,465,783 | A * | 11/1995 | O'Connor | 165/134.1 |
| 5,937,671 | A * | 8/1999 | Inoue et al. | 62/509 |
| 6,467,536 | B1 * | 10/2002 | Abate et al. | 165/153 |
| 6,935,413 | B2 * | 8/2005 | Kamishima et al. | 165/119 |
| 7,043,936 | B2 * | 5/2006 | Jung et al. | 62/509 |
| 2001/0025511 | A1 * | 10/2001 | Bernini | 62/531 |
| 2005/0279125 | A1 * | 12/2005 | Operschall | 62/474 |
| 2011/0253353 | A1 * | 10/2011 | Tokizaki et al. | 165/173 |
| 2012/0111547 | A1 * | 5/2012 | Suzuki et al. | 165/173 |

FOREIGN PATENT DOCUMENTS

| | | |
|---|---|---|
| JP | 2003-302126 | 10/2003 |

* cited by examiner

*Primary Examiner* — Leonard R Leo
(74) *Attorney, Agent, or Firm* — Mori & Ward, LLP

(57) ABSTRACT

A first header tank of a condenser serves as a condensation section outlet header section. A second header tank has lower end upper ends respectively located below and above the lower end of the first header tank. A portion of a second header tank located below the lower end of the first header tank serves as a super-cooling section inlet header section. The second header tank also serves as a reservoir section. The interior of the condensation section outlet header section of the first header tank communicates, through a communication section, with a portion of the interior of the second header tank, which portion is located above the lower end of the first header tank. A flow velocity reducing member is provided in the second header tank so as to reduce the flow velocity of liquid-phase dominant refrigerant which flows into the reservoir section through the communication section.

10 Claims, 11 Drawing Sheets

CONDENSER

CROSS-REFERENCE TO RELATED APPLICATIONS

The present application claims priority under 35 U.S.C. §119 to Japanese Patent Application No. 2012-157057, filed Jul. 13, 2012. The contents of this application are incorporated herein by reference in their entirety.

BACKGROUND OF THE INVENTION

1. Field of the Invention

The present invention relates to a condenser.

2. Discussion of the Background

A condenser for a car air conditioner is known (see, for example, Japanese Patent Application Laid-Open (kokai) No. 2003-302126). The known condenser has a condensation section and a super-cooling section provided such that the former is located above the latter. A reservoir section is provided between the condensation section and the super-cooling section such that its longitudinal direction coincides with the vertical direction. The condenser section includes at least one heat exchange path formed by a plurality of heat exchange tubes disposed in parallel such that their longitudinal direction coincides with the left-right direction and they are spaced apart from one another in the vertical direction, and a condensation section outlet header section which communicates with a downstream end portion (with respect to the flow direction of refrigerant) of the lower-end heat exchange path of the condensation section. The super-cooling section includes at least one heat exchange path formed by a plurality of heat exchange tubes disposed in parallel such that their longitudinal direction coincides with the left-right direction and they are spaced apart from one another in the vertical direction, and a super-cooling section inlet header section which is disposed on the same side with respect to the left-right direction as the condensation section outlet header section and which communicates with an upstream end portion (with respect to the flow direction of refrigerant) of the upper-end heat exchange path of the super-cooling section. The lower end of the reservoir section is located below the lower end of the condensation section outlet header section, and the upper end of the reservoir section is located above the lower end of the condensation section outlet header section. The condenser includes a header tank which is provided on the left or right end side and to which all the heat exchange tubes of the condensation section and the super-cooling section are connected, and the reservoir section formed separately from the header tank. The header tank is divided to upper and lower sections by a partition wall. The condensation section outlet header section is provided in the upper section of the header tank, and the super-cooling section inlet header section is provided in the lower section of the header tank. The interior of the condensation section outlet header section communicates, through a first communication section, with a portion of the interior of the reservoir section located above the lower end of the condensation section outlet header section, and a portion of the interior of the reservoir section located below first communication section communicates, through a second communication section, with the interior of the super-cooling section inlet header section of the header tank. A refrigerant inflow opening through which liquid-phase dominant refrigerant flows into the reservoir section is provided at the reservoir-section-side end of the first communication section. The liquid-phase dominant refrigerant flowing out of the condensation section outlet header section passes through the first communication section and laterally flows into the reservoir section through the refrigerant inflow opening. The liquid-phase dominant refrigerant having flowed into the reservoir section flows into the super-cooling section inlet header section through the second communication section.

In the case where the condenser described in the publication is incorporated into a refrigeration cycle of a car air conditioner, in order to determine the amount of refrigerant charged into the car air conditioner, the relation between the degree of super-cooling and the amount of charged refrigerant is obtained, and a charge graph as shown in FIG. 11 is made. When a portion of the interior of the reservoir section located above the center of the refrigerant inflow opening of the first communication section is filled with liquid-phase refrigerant, a stable range (S) of the charge graph of FIG. 11 within which the degree of super-cooling is constant is obtained.

SUMMARY OF THE INVENTION

According to one aspect of the present invention, a condenser includes a super-cooling section and a condensation section which is provided above the super-cooling section and which includes at least one first heat exchange path having a plurality of first heat exchange tubes disposed in parallel. A reservoir section is provided between the condensation section and the super-cooling section. A longitudinal direction of the reservoir section extends along a vertical direction. A longitudinal direction of the plurality of heat exchange tubes extends along a left-right direction perpendicular to the vertical direction. The plurality of heat exchange tubes are spaced apart from one another in the vertical direction. A condensation section outlet header section communicates with a downstream end portion with respect to a flow direction of refrigerant in the first heat exchange path at a lower end of the condensation section. The super-cooling section includes at least one second heat exchange path including a plurality of second heat exchange tubes disposed in parallel. A longitudinal direction of the plurality of second heat exchange tubes extends along the left-right direction. The plurality of second heat exchange tubes are spaced apart from one another in the vertical direction. A super-cooling section inlet header section is disposed on a same side as the condensation section outlet header section with respect to the left-right direction. The super-cooling section inlet header section communicates with an upstream end portion with respect to the flow direction of refrigerant in the second heat exchange path at an upper end of the super-cooling section. A lower end of the reservoir section is located below a lower end of the condensation section outlet header section. An upper end of the reservoir section is located above the lower end of the condensation section outlet header section. An interior of the condensation section outlet header section communicates, through a communication section, with a portion of an interior of the reservoir section. The portion is located above the lower end of the condensation section outlet header section so that liquid-phase dominant refrigerant flowing from the condensation section outlet header section passes through the communication section and laterally flows into the reservoir section. A flow velocity reducing member is provided in the reservoir section at a vertical position corresponding to an end portion of the communication section located on the side toward the reservoir section. The flow velocity reducing member is configured to reduce a flow velocity of the liquid-phase dominant refrigerant which passes through the communication section and flows into the reservoir section.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
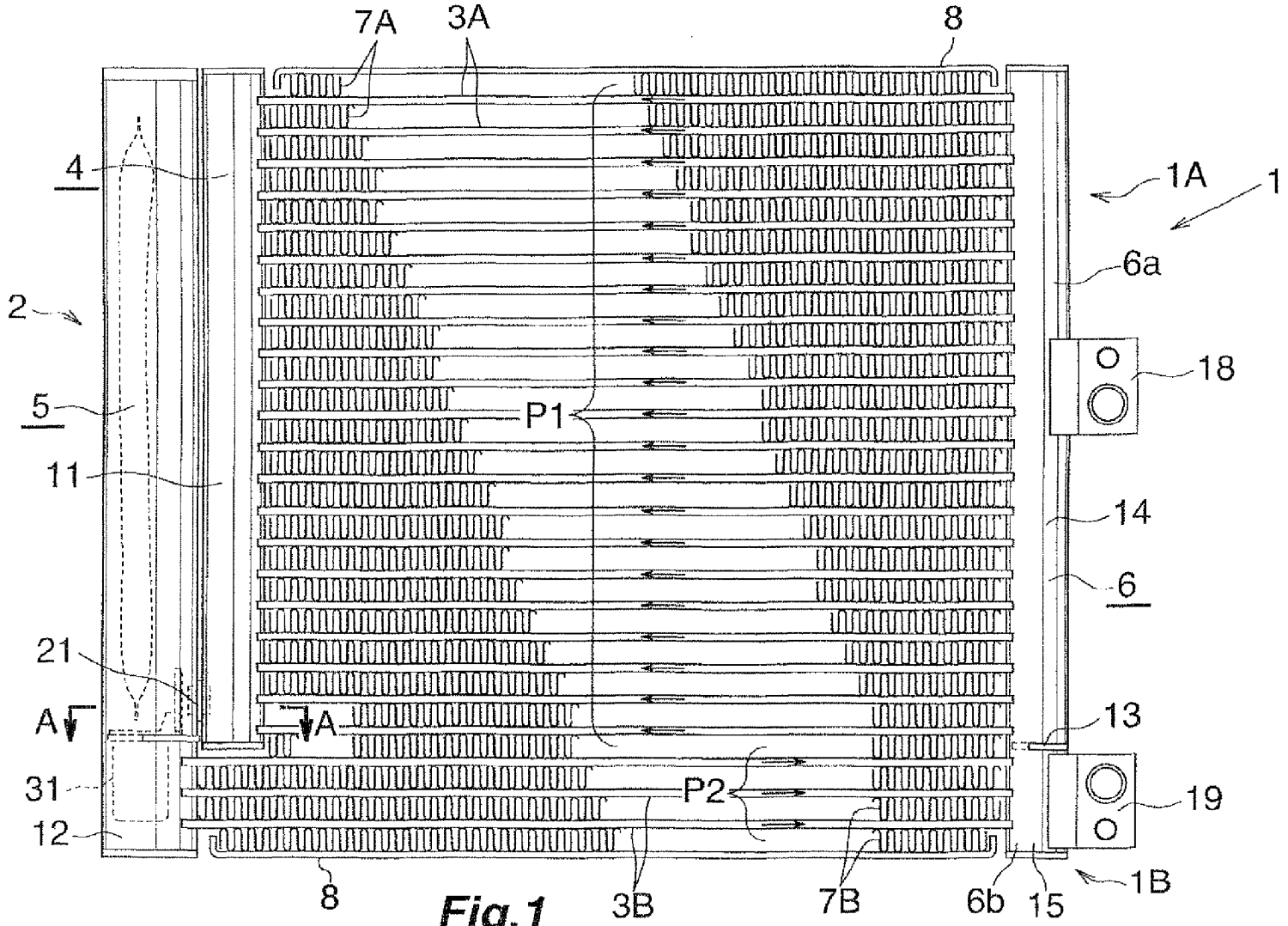
FIG. 1 is a front view specifically showing the overall structure of a first embodiment of a condenser according to the present invention.

Embodiments of the present invention will next be described with reference to the drawings.

In the following description, the term "aluminum" includes aluminum alloys in addition to pure aluminum.

Like portions and components are denoted by like reference numerals throughout the drawings, and they will not be described redundantly.

Figure 2:
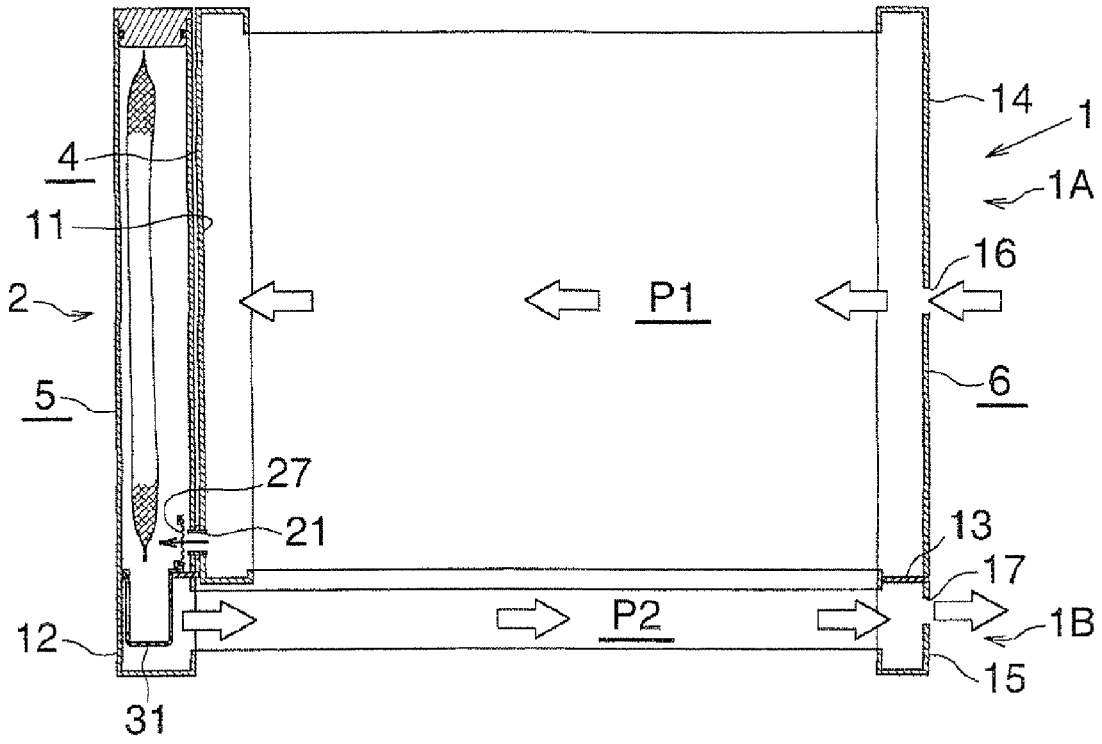
FIG. 2 is a front view schematically showing the condenser of FIG. 1.
Figure 9:
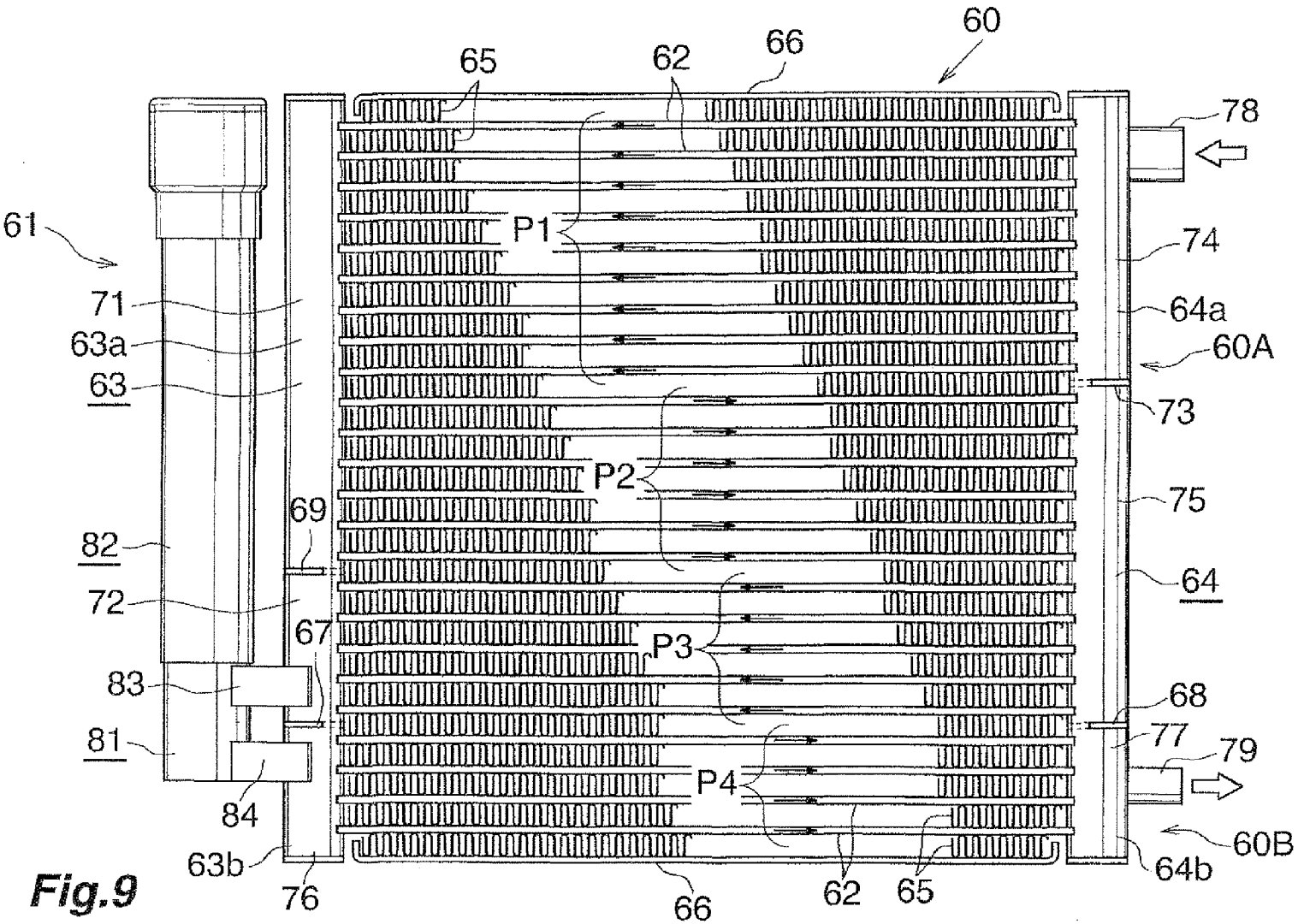
FIG. 9 is a front view specifically showing the overall structure of a third embodiment of the condenser according to the present invention.

The upper side, lower side, left-hand side, and right-hand side in FIGS. 1, 2, and 9 will be referred to as "upper," "lower," "left," and "right," respectively.

FIG. 1 specifically shows the overall structure of a first embodiment of a condenser according to the present invention. FIG. 2 schematically shows the condenser of FIG. 1. FIGS. 3 to 6 show the structure of a main portion of the condenser of FIG. 1. In FIG. 2, individual heat exchange tubes are not illustrated, and corrugate fins, side plates, a refrigerant inlet member, and a refrigerant outlet member are also not illustrated.

In FIGS. 1 and 2, a condenser 1 has a condensation section 1A and a super-cooling section 1B provided such that the former is located above the latter. A reservoir section 2 is provided between the condensation section 1A and the super-cooling section 1B such that its longitudinal direction coincides with the vertical direction. The condenser 1 includes a plurality of flat heat exchange tubes 3A, 3B formed of aluminum, three header tanks 4, 5, 6 formed of aluminum, corrugate fins 7A, 7B formed of aluminum, and side plates 8 formed of aluminum. The heat exchange tubes 3A, 3B are disposed such that their width direction coincides with an air passage direction (perpendicular to the sheets of FIGS. 1 and 2), their longitudinal direction coincides with the left-right direction, and they are spaced from one another in the vertical direction. The header tanks 4, 5, 6 are disposed such that their longitudinal direction coincides with the vertical direction, and left and right end portions of the heat exchange tubes 3A, 3B are brazed to the header tanks 4, 5, 6. Each of the corrugate fins 7A, 7B is disposed between and brazed to adjacent heat exchange tubes 3A, 3B, or is disposed on the outer side of the uppermost or lowermost heat exchange tube 3A, 3B and brazed to the corresponding heat exchange tube 3A, 3B. The side plates 8 are disposed on the corresponding outer sides of the uppermost and lowermost corrugate fins 7A, 7B, and are brazed to these corrugate fins 7A, 7B.

Each of the condensation section 1A and super-cooling section 1B of the condenser 1 includes at least one (only one in the present embodiment) heat exchange path P1, P2 formed by a plurality of heat exchange tubes 3A, 3B successively arranged in the vertical direction. The heat exchange path P1 provided in the condensation section 1A serves as a refrigerant condensation path. The heat exchange path P2 provided in the super-cooling section 1B serves as a refrigerant super-cooling path. The flow direction of refrigerant is the same among all the heat exchange tubes 3A, 3B which form the respective heat exchange paths P1, P2. The flow direction of refrigerant in the heat exchange tubes 3A, 3B which form a certain heat exchange path is opposite the flow direction of refrigerant in the heat exchange tubes 3A, 3B which form another heat exchange path adjacent to the certain heat exchange path. The heat exchange path P1 of the condensation section 1A will be referred to as the first heat exchange path, and the heat exchange path P2 of the super-cooling section 1B will be referred to as the second heat exchange path.

The first header tank 4 and the second header tank 5 are individually provided at the left end of the condenser 1 such that the second header tank 5 is located on the outer side with respect to the left-right direction. Left end portions of all the heat exchange tubes 3A, which form the first heat exchange path P1 provided in the condensation section 1A, are connected to the first header tank 4 through brazing. Left end portions of the heat exchange tubes 3B, which form the second heat exchange path P2 provided in the super-cooling section 1B, are connected to the second header tank 5 through brazing. The upper end of the second header tank 5 is located above the lower end of the first header tank 4. In the present embodiment, the upper end of the second header tank 5 is located at substantially the same height as the upper end of the first header tank 4. The lower end of the second header tank 5 is located below the lower end of the first header tank 4. All the heat exchange tubes 3B, which form the second heat exchange path P2, are brazed to a portion of the second header tank 5 located below the first header tank 4. The second header tank 5 also serves as a reservoir section 2 which stores liquid-phase dominant refrigerant produced as a result of condensation at the condensation section 1A and which supplies the liquid-phase dominant refrigerant to the super-cooling section 1B.

The entirety of the first header tank 4 serves as a single condensation section outlet header section 11 which communicates with a downstream end portion (with respect to the flow direction of refrigerant) of the first heat exchange path P1 of the condensation section 1A (the heat exchange path at the lower end of the condensation section 1A). A portion of the second header tank 5 located below the lower end of the first header tank 4 serves as a super-cooling section inlet header section 12 which communicates with an upstream end portion (with respect to the flow direction of refrigerant) of the second heat exchange path P2 of the super-cooling section 1B (the heat exchange path at the upper end of the super-cooling section 1B).

The third header tank 6 is disposed at the right end of the condenser 1. Right end portions of all the heat exchange tubes 3A, 3B which form the first and second heat exchange paths P1, P2 are connected to the third header tank 6. The third header tank 6 has a transverse cross-sectional shape identical with that of the first header tank 4.

The interior of the third header tank 6 is divided into an upper section 6*a* and a lower section 6*b* by an aluminum partition plate 13 provided at a vertical position between the first heat exchange path P1 and the second heat exchange path P2. The upper section 6*a* serves as a single condensation section inlet header section 14 which communicates with an upstream end portion (with respect to the flow direction of refrigerant) of the first heat exchange path P1 of the condensation section 1A. The lower section 6*b* serves as a super-cooling section outlet header section 15 which communicates with a downstream end portion (with respect to the flow direction of refrigerant) of the second heat exchange path P2 of the super-cooling section 1B. The condensation section inlet header section 14 of the third header tank 6 has a refrigerant inlet 16 formed at the vertically middle position thereof, and the super-cooling section outlet header section 15 of the third header tank 6 has a refrigerant outlet 17. A refrigerant inlet member 18 communicating with the refrigerant inlet 16 and a refrigerant outlet member 19 communicating with the refrigerant outlet 17 are joined to the third header tank 6.

Figure 3:
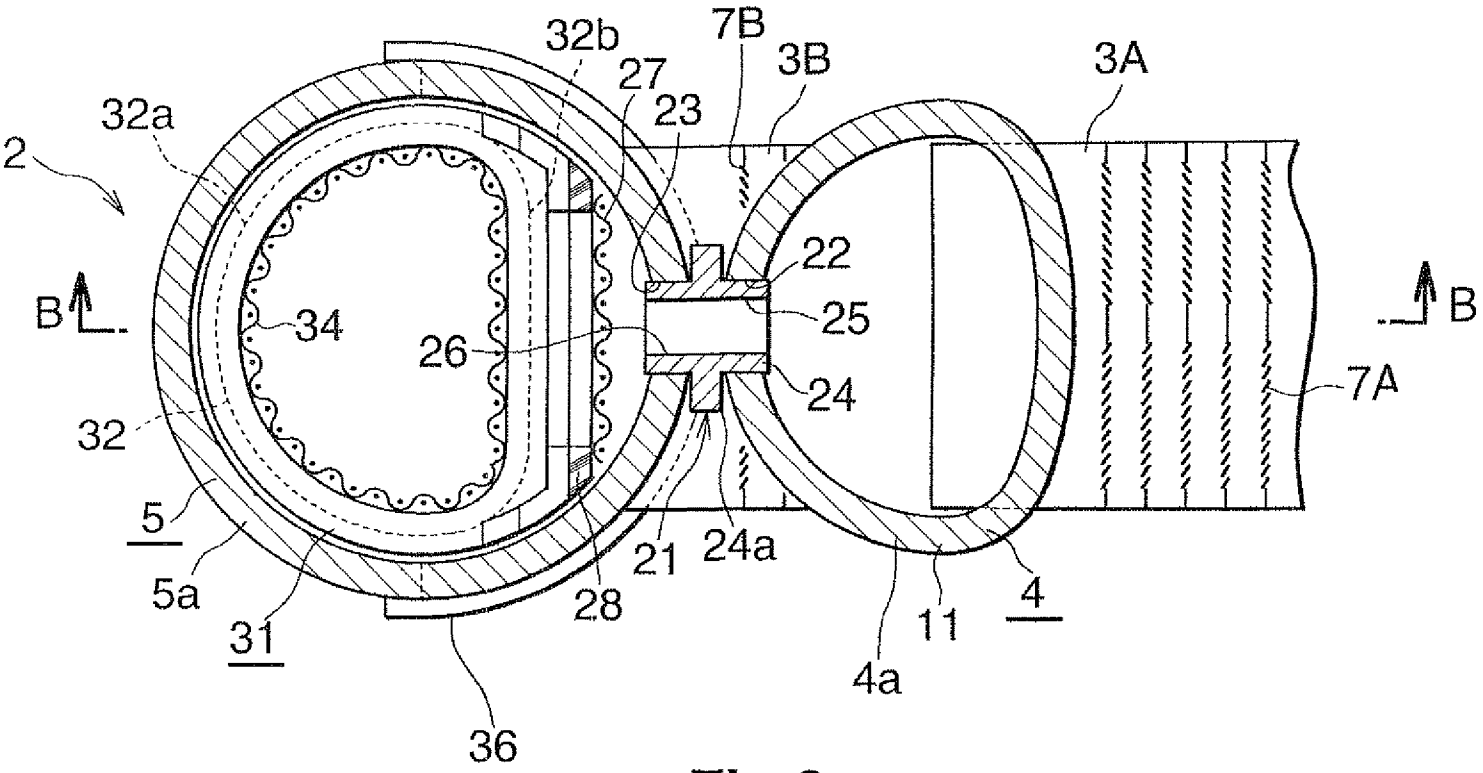
FIG. 3 is an enlarged sectional view taken along line A-A of FIG. 1.
Figure 4:
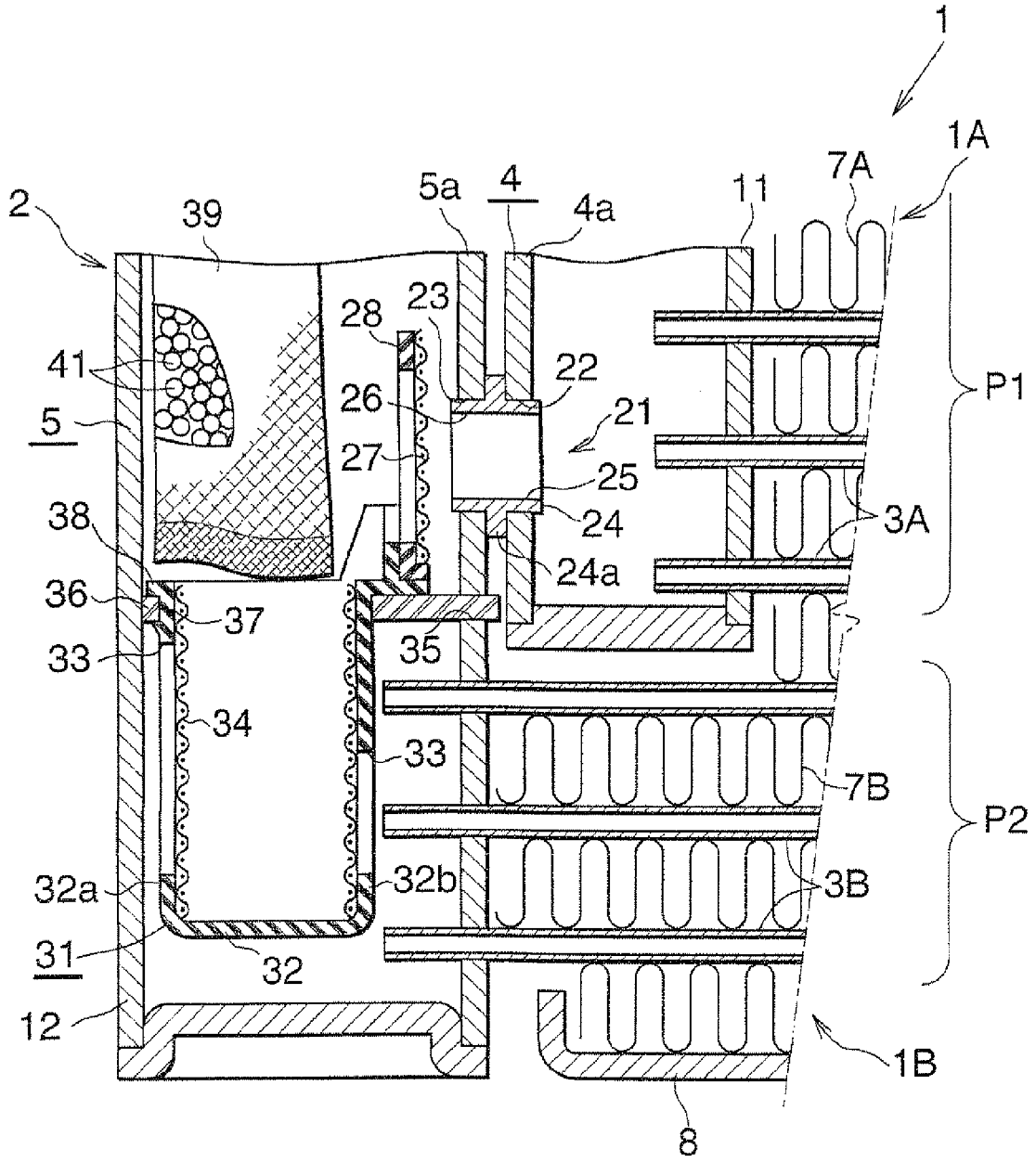
FIG. 4 is a sectional view taken along line B-B of FIG. 3.
Figure 5:
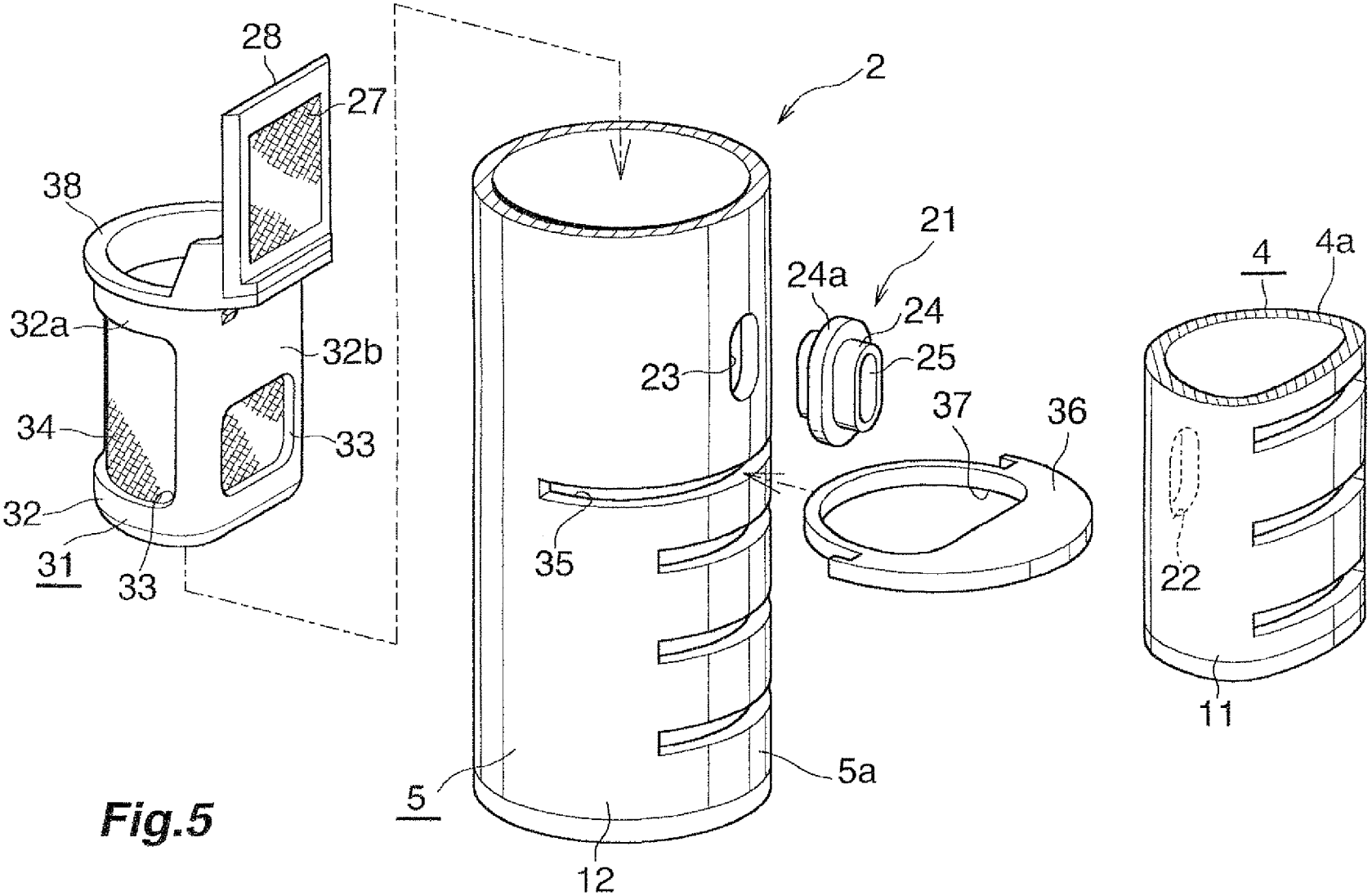
FIG. 5 is an exploded perspective view showing a main portion of the condenser of FIG. 1.

As shown in FIGS. 3 to 5, a communication section 21 establishes communication between a portion of the interior of the condensation section outlet header section 11 of the first header tank 4, which portion is located below the vertically middle position thereof and near the lower end thereof, and a portion of the interior of the second header tank 5, which portion is located above the lower end of the condensation section outlet header section 11. The communication section 21 includes a through hole 22 formed in the circumferential wall 4*a* of the first header tank 4, a through hole 23 formed in the circumferential wall 5*a* of the second header tank 5 at the same vertical position as the through hole 22 of the first header tank 4, and a horizontal tubular communication member 24 formed of aluminum. The communication member 24 is disposed between the first header tank 4 and the second header tank 5 and is brazed to these header tanks 4, 5. The communication member 24 has a flow passage 25 which establishes communication between the through hole 22 of the header tank 4 and the through hole 23 of the header tank 5. The communication member 24 has an outward bulging portion 24*a* which is formed at a central position thereof with respect to the longitudinal direction and which is located between the two header tanks 4, 5. A portion of the communication member 24 located on the right side of the outward bulging portion 24*a* is inserted into the through hole 22 of the first header tank 4, and is brazed to the circumferential wall 4*a* of the first header tank 4. A portion of the communication member 24 located on the left side of the outward bulging portion 24*a* is inserted into the through hole 23 of the second header tank 5, and is brazed to the circumferential wall 5*a* of the second header tank 5. The left end opening of the flow passage 25 of the communication member 24 serves as a refrigerant inflow opening 26 through which liquid-phase dominant refrigerant flows into the reservoir section 2. Each of the through holes 22, 23 has a vertically elongated oval shape, and the transverse cross-sectional shape of the communication member 24 is a vertically elongated oval shape.

Figure 6:
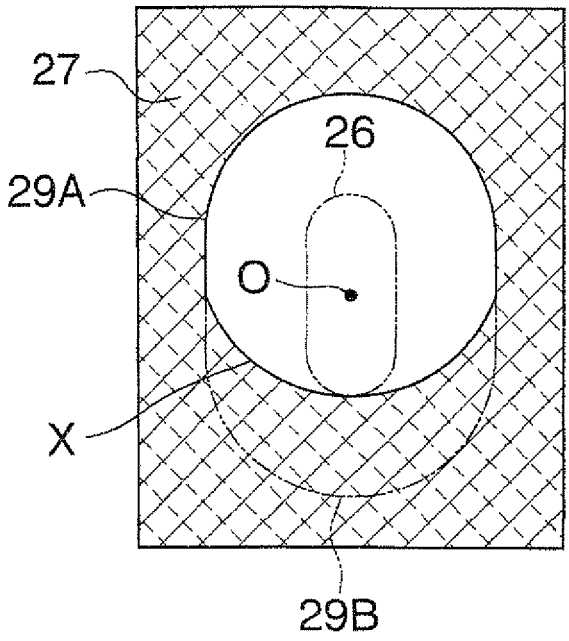
FIG. 6 is a view showing a mesh-like material used as a flow velocity reducing member in the condenser of FIG. 1.

A flow velocity reducing member 27 is provided in the second header tank 5, which serves as the reservoir section 2. The flow velocity reducing member 27 reduces the flow velocity of liquid-phase dominant refrigerant which passes through the communication section 21 and laterally flows from the refrigerant inflow opening 26 into the second header tank 5. The flow velocity reducing member 27 is formed of a mesh-like material, and is boned to the right side of a vertically elongated rectangular support frame 28, which is formed of a synthetic resin and is disposed upright, such that the flow velocity reducing member 27 covers an opening surrounded by the support frame 28. Preferably, the mesh-like material which constitutes the flow velocity reducing member 27 has an opening size of 160 μm or less and an opening ratio of 50% or less. The opening ratio is obtained by an expression {the opening size of a mesh/the diameter of wire which forms the mesh+the opening size}$^2$×100%. Also, it is preferred that the size of the flow velocity reducing member 27 and the distance between the flow velocity reducing member 27 and the refrigerant inflow opening 26 be determined as follows. Namely, it is preferred that the size of the flow velocity reducing member 27 and the distance between the flow velocity reducing member 27 and the refrigerant inflow opening 26 be determined such that, as shown in FIG. 6, a perspective projection image 29A of an upper half of the inner circumferential edge of the refrigerant inflow opening 26 is present on the flow velocity reducing member 27. The perspective projection image 29A is obtained by drawing a horizontal line which passes through the center O of the refrigerant inflow opening 26 and extends in the left-right direction, setting a view point on the horizontal line to be located on a side of the refrigerant inflow opening 26 toward the condensation section outlet header section 11, and projecting the upper half of the inner circumferential edge of the refrigerant inflow opening 26 on the flow velocity reducing member 27 by a one-point perspective projection method, with the angle between a projection line and the horizontal line set to 45 degrees. Moreover, a perspective projection image 29B of a lower half of the inner circumferential edge of the refrigerant inflow opening 26 is not necessarily required to be present on the flow velocity reducing member 27. The perspective projection image 29B is obtained by drawing a horizontal line which passes through the center O of the refrigerant inflow opening 26 and which extends in the left-right direction, setting a view point on the horizontal line to be located on a side of the refrigerant inflow opening 26 toward the condensation section outlet header section 11, and projecting the lower half of the inner circumferential edge of the refrigerant inflow opening 26 on the flow velocity reducing member 27 by the one-point perspective projection method, with the angle between a projection line and the horizontal line set to 45 degrees. However, it is preferred that an arc X which connects three points; i.e., the left and right ends of the upper perspective projection image 29A and a portion of the flow velocity reducing member 27 corresponding to the lower end of the refrigerant inflow opening 26, is also present on the flow velocity reducing member 27 of FIG. 6. The reason for this is as follows. Since the refrigerant stagnating in a lower portion of the condensation section outlet header section 11 hardly contains gas-phase refrigerant, the refrigerant which passes through a lower portion of the flow passage 25 and flows into the reservoir section 2 from a lower portion of the refrigerant inflow opening 26 hardly contains gas-phase refrigerant. Therefore, a portion of the lower perspective projection image 29B located below the arc X need not be present on the flow velocity reducing member 27.

A foreign matter removal member 31 for removing foreign matter from refrigerant is disposed in the second header tank 5. The foreign matter removal member 31 includes a bottomed cylindrical frame member 32 which is formed of a synthetic resin, which is disposed such that its longitudinal direction coincides with the vertical direction, and which is open at the upper end thereof and is closed at the lower end thereof; and a mesh-like filter 34 which covers a plurality of communication openings 33 formed in the circumferential wall 32*a* of the frame member 32. The upper end of the frame member 32 is located between the first heat exchange path P1 and the second heat exchange path P2, and the lower end of the frame member 32 is located above the lower-end heat exchange tube 3B of the second heat exchange path P2. A flat portion 32*b* is provided on a portion (i.e., a right-side portion) of the circumferential wall 32*a* of the frame member 32 in order to prevent interference between the frame member 32 and the left ends of the heat exchange tubes 3B of the second heat exchange path P2.

The foreign matter removal member 31 is attached to a plate 36 which is formed of aluminum and which is externally inserted into a slit 35 formed in the circumferential wall 5*a* of the second header tank 5 and is brazed to the circumferential wall 5*a*. The plate 36 has a through hole 37 through which the frame member 32 of the foreign matter removal member 31 is passed. The frame member 32 is inserted into the through hole 37 from the upper side such that an outward flange 38 formed at the upper end of the circumferential wall 32*a* of the frame member 32 rests on a portion of the plate 36 around the through hole 37. The support frame 28 of the flow velocity reducing member 27 formed of a mesh-like material is integrally formed at the right-side portion of the outward flange 38.

A desiccant container 39 filled with a desiccant 41 is disposed within the second header tank 5 to be located above the plate 36. The desiccant container 39 is formed of a material which permits passage of refrigerant therethrough but prevents passage of the desiccant 41 therethrough. The support frame 28 prevents the desiccant container 39 from coming into contact with the flow velocity reducing member 27. The communication section 21 has a first end portion and a second end portion opposite to the first end portion in the extending direction. The first end portion is brazed to the first header tank 4. The second end portion is brazed to the second header tank 5. The plurality of heat exchange tubes (long heat exchange tubes) 3B are inserted into the second header tank 5 to have tube ends of the heat exchange tubes 3B in the second header tank 5 and to have an inside length in the extending direction from the tube ends of the heat exchange tubes 3B to an inner surface of the second header tank 5. A distance in the extending direction from the second end portion of the communication section 21 to the flow velocity reducing member 27 is smaller than the inside length in the extending direction of the heat exchange tubes 3B.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the condensation section inlet header section 14 of the third header tank 6 through the refrigerant inlet member 18 and the refrigerant inlet 16. The gas phase refrigerant is condensed while flowing leftward within the heat exchange tubes 3A of the first heat exchange path P1, and liquid-phase dominant refrigerant flows into the condensation section outlet header section 11 of the first header tank 4. The liquid-phase dominant refrigerant having flowed into the condensation section outlet header section 11 of the first header tank 4 passes through the flow passage 25 of the communication member 24, which constitutes the communication section 21, and laterally flows into the second header tank 5 from the refrigerant inflow opening 26.

Figure 11:
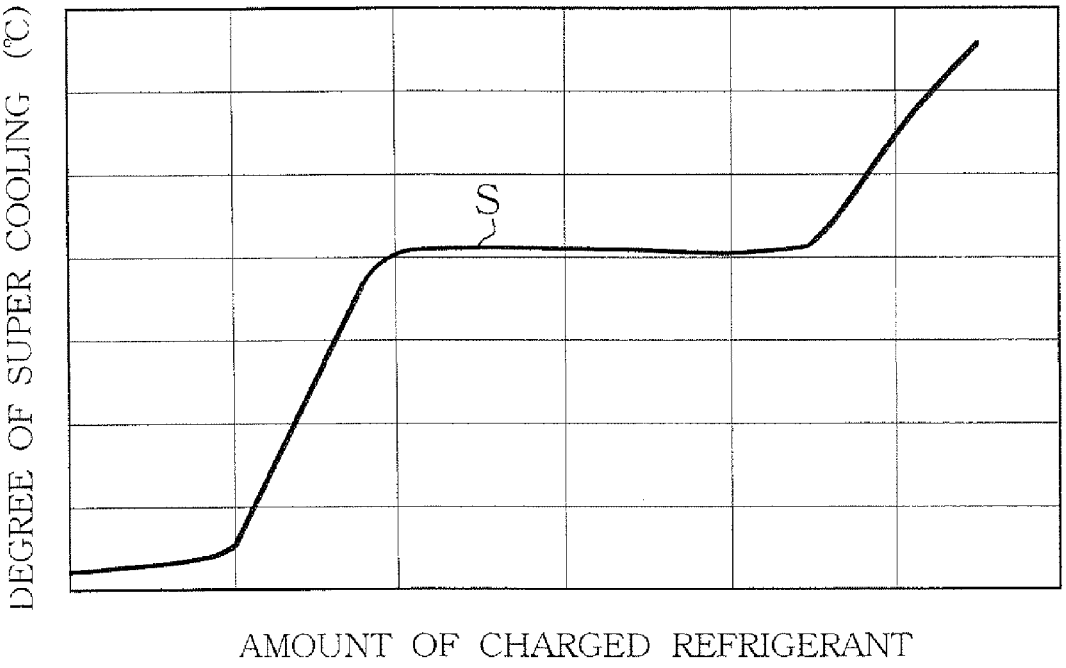
FIG. 11 is a charge graph showing the relation between the degree of super-cooling and the amount of charged refrigerant.

The liquid-phase dominant refrigerant having flowed into the second header tank 5 in the lateral direction is caused to pass through the flow velocity reducing member 27, whereby its flow velocity is reduced. The liquid-phase dominant refrigerant having a reduced flow velocity flows downward due to gravity, and the gas-phase refrigerant which is contained in the liquid-phase dominant refrigerant in the form of bubbles also flows downward together with the liquid-phase dominant refrigerant. The liquid-phase dominant refrigerant containing the gas-phase refrigerant in the form of bubbles and having flowed downward enters the super-cooling section inlet header section 12 through the upper end opening of the frame member 32 of the foreign matter removal member 31 and the filter 34 which covers the communication openings 33. Accordingly, a portion of the interior of the reservoir section 2, which portion is located above the center (with respect to the vertical direction) of the refrigerant inflow opening 26 of the communication member 24 of the communication section 21, is quickly filled with liquid-phase refrigerant. As a result, the range of the refrigerant charge amount corresponding to the stable range S which is indicated on the charge graph shown in FIG. 11 and within which the degree of super-cooling becomes constant can be made wider than that in the case of the condenser described in the above-mentioned publication. Thus, a super-cooling characteristic which is stable against change in load and leakage of refrigerant can be obtained.

The refrigerant having flowed into the super-cooling section inlet header section 12 enters the heat exchange tubes 3B of the second heat exchange path P2, and is super-cooled, while flowing rightward within the heat exchange tubes 3B. After that, the refrigerant enters the super-cooling section outlet header section 15 of the third header tank 6, and flows out through the refrigerant outlet 17 and the refrigerant outlet member 19. The refrigerant is then fed to the evaporator via the expansion valve.

The condenser shown in FIGS. 1 and 2 may be modified such that the condensation section 1A includes a plurality of heat exchange paths which are juxtaposed in the vertical direction and each of which is formed a plurality of heat exchange tubes 3A successively arranged in the vertical direction, and the super-cooling section 1B includes a plurality of heat exchange paths which are juxtaposed in the vertical direction and each of which is formed a plurality of heat exchange tubes 3B successively arranged in the vertical direction. In the case where the condensation section 1A includes a plurality of heat exchange paths which are juxtaposed in the vertical direction, each of the interior of the first header tank 4 and the interior of the third header tank 6 is divided into a plurality of header sections by a partition member(s) provided at a proper vertical position(s) such that refrigerant successively flows through the plurality of heat exchange paths from the heat exchange path at the upper end toward the heat exchange path at the lower end, and the header section at the lower end of the first header tank 4 serves as the condensation section outlet header section 11. Also, in the case where the super-cooling section 1B includes a plurality of heat exchange paths which are juxtaposed in the vertical direction, each of the interior of the second header tank 5 and the interior of the third header tank 6 is divided into a plurality of header sections by a partition member(s) provided at a proper vertical position(s) such that refrigerant successively flows through the plurality of heat exchange paths from the heat exchange path at the upper end toward the heat exchange path at the lower end, and the header section at the upper end of the second header tank 5 serves as the super-cooling section inlet header section 12.

Figure 7:
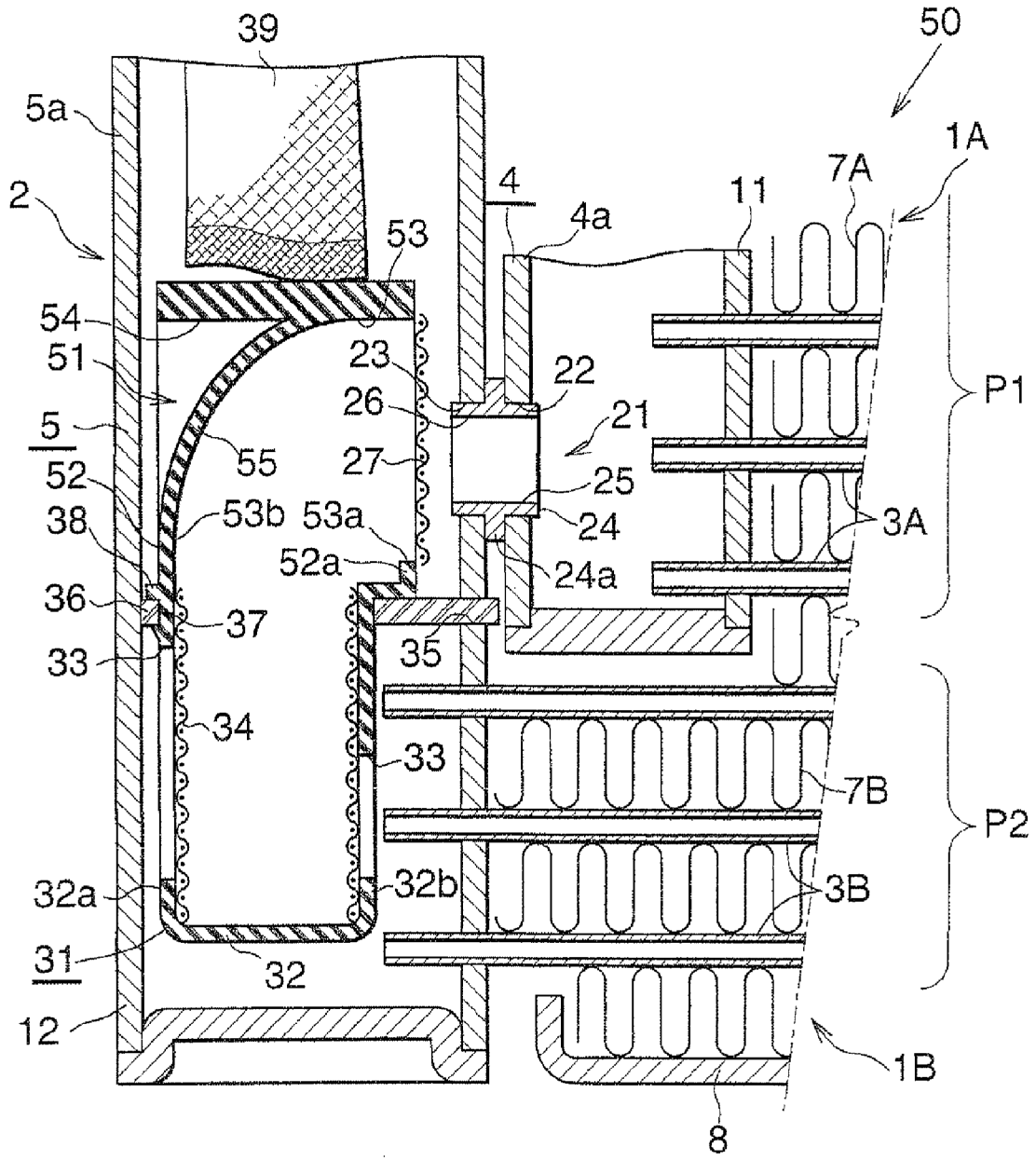
FIG. 7 is a view corresponding to FIG. 4 and showing the structure of a main portion of a second embodiment of the condenser according to the present invention.
Figure 8:
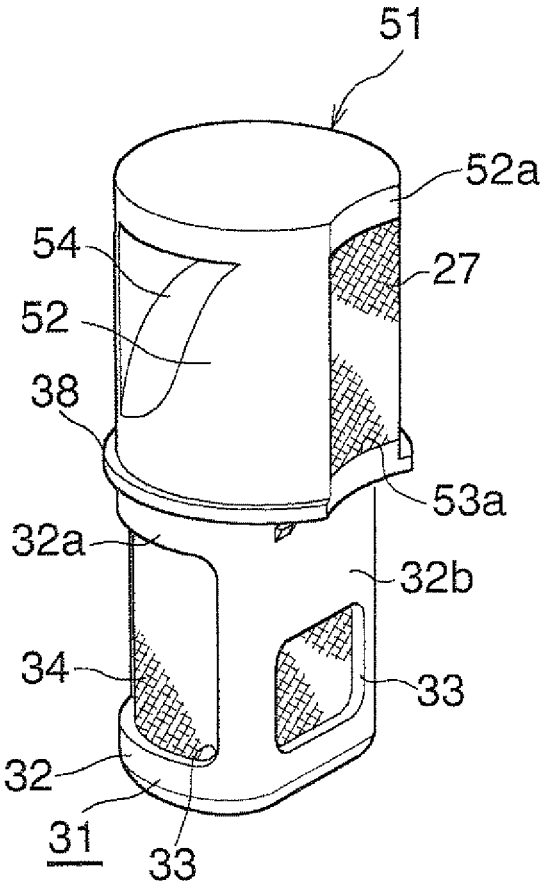
FIG. 8 is a perspective view showing a guide and a foreign matter removal member used in the condenser of FIG. 7.

FIGS. 7 and 8 show a second embodiment of the condenser according to the present invention.

In the case of the condenser 50 shown in FIGS. 7 and 8, a guide 51 formed of a synthetic resin is provided in the second header tank 5, which serves as the reservoir section 2. The guide 51 guides the liquid-phase dominant refrigerant which has passed through the flow passage 25 of the communication member 24, which constitutes the communication section 21, and has laterally flowed into the reservoir section 2 from the refrigerant inflow opening 26, such that the liquid-phase dominant refrigerant flows downward. The guide 51 projects upward from the outward flange 38 at the upper end of the circumferential wall 32*a* of the frame member 32 of the foreign matter removal member 31. The guide 51 has a bent refrigerant flow passage 53. One end of the flow passage 53 is open to a concave cylindrical portion 52*a* which is provided on a right-side portion of the outer circumferential surface 52 and extends in the vertical direction. The other end of the flow passage 53 is open to the lower surface. An arcuate guide portion 55 is provided such that it extends from an upper portion of the inner circumferential surface of the refrigerant flow passage 53 to a left portion thereof. The arcuate guide portion 55 changes the flow direction of the refrigerant which flows into the refrigerant flow passage 53 from an opening 53*a* thereof at the concave cylindrical portion 52*a* such that the refrigerant flows downward to a downward opening 53*b*. A lightening cavity 54 is provided on the outer circumferential surface 52 of the guide 51 so as to reduce the weight. A mesh-like material, which serves as the flow velocity reducing member 27, is bonded to the concave cylindrical portion 52*a* of the outer circumferential surface 52 of the guide 51 such that the mesh-like material covers the rightward opening 53*a* of the refrigerant flow passage 53.

The remaining structure is identical with that of the condenser shown in FIGS. 1 to 6.

In the case of the condenser of the second embodiment, the flow velocity of the liquid-phase dominant refrigerant having passed through the flow passage 25 of the communication member 24 of the communication section 21 and flowed into the reservoir section 2 from the refrigerant inflow opening 26 is reduced by the flow velocity reducing member 27. The liquid-phase dominant refrigerant is then guided to flow downward by the guide portion 55 of the refrigerant flow passage 53 of the guide 51, and the gas-phase refrigerant which is contained in the liquid-phase dominant refrigerant in the form of bubbles is also caused to move downward together with the liquid-phase dominant refrigerant. The liquid-phase dominant refrigerant containing the gas-phase refrigerant in the form of bubbles and having flowed downward enters the super-cooling section inlet header section 12 through the downward opening 53*b* of the refrigerant flow passage 53, the upper end opening of the frame member 32 of the foreign matter removal member 31, and the filter 34 which covers the communication openings 33. Accordingly, a portion of the interior of the reservoir section 2, which portion is located above the center (with respect to the vertical direction) of the refrigerant inflow opening 26 of the communication member 24 of the communication section 21, is quickly filled with liquid-phase refrigerant. As a result, the range of the refrigerant charge amount corresponding to the stable range S which is indicated on the charge graph shown in FIG. 11 and within which the degree of super-cooling becomes constant can be made wider than that in the case of the condenser described in the above-mentioned publication. Thus, a super-cooling characteristic which is stable against change in load and leakage of refrigerant can be obtained.

Figure 10:
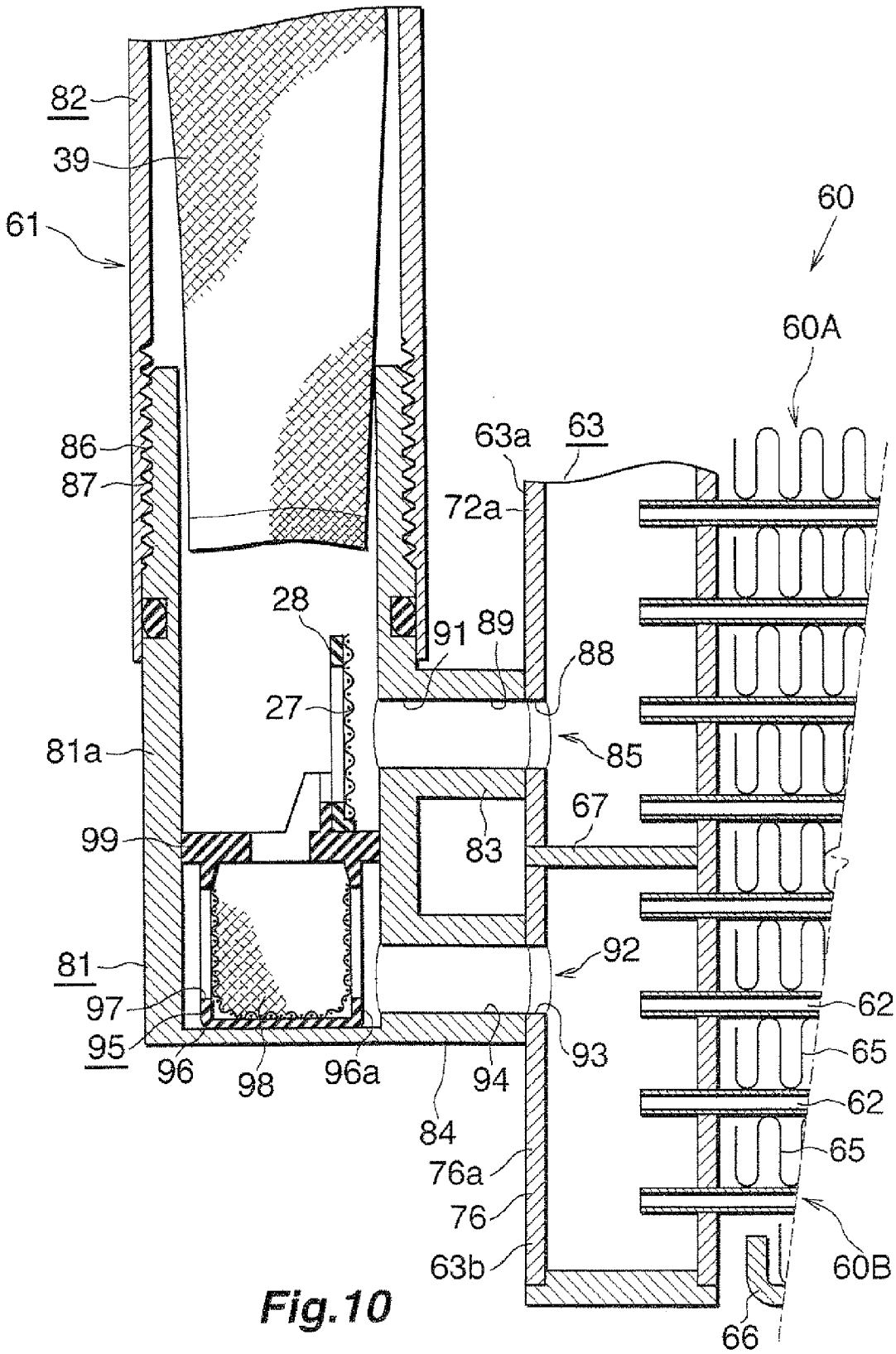
FIG. 10 is a vertical sectional view of a main portion of the condenser of FIG. 9 as viewed from the front side.

FIGS. 9 and 10 show a third embodiment of the condenser according to the invention.

In FIG. 9, a condenser 60 has a condensation section 60A and a super-cooling section 60B provided such that the former is located above the latter. A reservoir section 61 whose longitudinal direction coincides with the vertical direction is provided between the condensation section 60A and the super-cooling section such 60B, separately from the condensation section 60A and the super-cooling section 60B. The condenser 60 includes a plurality of flat heat exchange tubes 62 formed of aluminum, two header tanks 63, 64 formed of aluminum, corrugate fins 65 formed of aluminum, and side plates 66 formed of aluminum. The heat exchange tubes 62 are disposed such that their width direction coincides with the air passage direction, their longitudinal direction coincides with the left-right direction, and they are spaced from one another in the vertical direction. The header tanks 63, 64 are disposed such that their longitudinal direction coincides with the vertical direction, and left and right end portions of the heat exchange tubes 62 are brazed to the header tanks 63, 64. Each of the corrugate fins 65 is disposed between and brazed to adjacent heat exchange tubes 62, or is disposed on the outer side of the uppermost or lowermost heat exchange tube 62 and brazed to the corresponding heat exchange tube 62. The side plates 66 are disposed on the corresponding outer sides of the uppermost and lowermost corrugate fins 65, and are brazed to these corrugate fins 65.

The condensation section 60A of the condenser 60 includes at least one heat exchange path formed by a plurality of heat exchange tubes 62 successively arranged in the vertical direction. In the present embodiment, the condensation section 60A includes three heat exchange paths P1, P2, P3. The super-cooling section 60B of the condenser 60 includes at least one heat exchange path formed by a plurality of heat exchange tubes 62 successively arranged in the vertical direction. In the present embodiment, the super-cooling section 60B includes one heat exchange path P4. The three heat exchange paths P1, P2, P3 provided in the condensation section 60A serve as refrigerant condensation paths. The one heat exchange path P4 provided in the super-cooling section 60B serves as a refrigerant super-cooling path. The flow direction of refrigerant is the same among all the heat exchange tubes 62 which form the respective heat exchange paths P1, P2, P3, P4. The flow direction of refrigerant in the heat exchange tubes 62 which form a certain heat exchange path is opposite the flow direction of refrigerant in the heat exchange tubes 62 which form another heat exchange path adjacent to the certain heat exchange path. The three heat exchange paths P1, P2, P3 provided in the condensation section 60A will be referred to as the first, second, and third heat exchange paths from the upper side. The heat exchange path P4 of the super-cooling section 60B will be referred to as the fourth heat exchange path.

The interior of the header tank 63 at the left end of the condenser 60 is divided into upper and lower sections 63*a*, 63*b* by a partition member 67 at a vertical position between the third heat exchange path P3 and the fourth heat exchange path P4. Similarly, the interior of the header tank 64 at the right end of the condenser 60 is divided into upper and lower sections 64*a*, 64*b* by a partition member 68 at a vertical position between the third heat exchange path P3 and the fourth heat exchange path P4. Thus, the condensation section 60A, which condenses gas-phase refrigerant into the liquid phase, and the super-cooling section 60B, which super-cools the liquid refrigerant condensed by the condensation section 60A, are provided such that the former is located above the latter.

The upper section 63*a* of the left header section 63 of the condenser 60 located above the partition member 67 is divided into a left-side intermediate header section 71 and a condensation section outlet header section 72 by a division member 69 formed of aluminum at a vertical position between the second heat exchange path P2 and the third heat exchange path P3. The left-side intermediate header section 71 communicates with a downstream end portion (with respect to the flow direction of refrigerant) of the first heat exchange path P1 of the condensation section 60A and an upstream end portion (with respect to the flow direction of refrigerant) of the second heat exchange path P2 of the condensation section 60A. The condensation section outlet header section 72 communicates with a downstream end portion (with respect to the flow direction of refrigerant) of the third heat exchange path P3 of the condensation section 60A. The upper section 64*a* of the right header section 64 of the condenser 60 located above the partition member 68 is divided into a condensation section inlet header section 74 and a right-side intermediate header section 75 by a division member 73 formed of aluminum at a vertical position between the first heat exchange path P1 and the second heat exchange path P2. The condensation section inlet header section 74 communicates with an upstream end portion (with respect to the flow direction of refrigerant) of the first heat exchange path P1. The right-side intermediate header section 75 communicates with a downstream end portion (with respect to the flow direction of refrigerant) of the second heat exchange path P2 and an upstream end portion (with respect to the flow direction of refrigerant) of the third heat exchange path P3.

The entire lower section 63*b* of the left header section 63 of the condenser 60 located below the partition member 67 serves as a super-cooling section inlet header section 76 which communicates with an upstream end portion (with respect to the flow direction of refrigerant) of the fourth heat exchange path P4. The entire lower section 64*b* of the right header section 64 of the condenser 60 located below the partition member 68 serves as a super-cooling section outlet header section 77 which communicates with a downstream end portion (with respect to the flow direction of refrigerant) of the fourth heat exchange path P4. A refrigerant inlet (not shown) is formed at an upper portion of the condensation section inlet header section 74 of the right header tank 6, and a refrigerant inlet (not shown) is formed at the super-cooling section outlet header section 77. A refrigerant inlet member 78 communicating with the refrigerant inlet and a refrigerant outlet member 79 communicating with the refrigerant outlet are joined to the right header tank 64.

The reservoir section 61 is composed of a base member 81 which is formed of aluminum and is fixed to a lower portion of the left header section 63 by brazing or the like, and a cylindrical reservoir section main body 82 which is formed of aluminum and is removably attached to the base member 81. The reservoir section main body 82 is closed at the upper end and is open at the lower end. The upper end of the reservoir section 61 is located above the lower end of the condensation section outlet header section 72, and the lower end of the reservoir section 61 is located above the upper end of the super-cooling section inlet header section 76.

As shown in FIG. 10, the base member 81 is a cylindrical member which is closed at the lower end and is open at the upper end. A fixing portion 83 projects rightward from the circumferential wall 81*a* of the base member 81 at a position corresponding to a portion of the condensation section outlet header section 72 of the left header section 63 located below the vertically middle position thereof. Similarly, a fixing portion 84 projects rightward from the circumferential wall 81*a* at a position corresponding to a portion of the super-cooling section inlet header section 76 of the left header section 63 located above the vertically middle position thereof. The distal end of the upper fixing portion 83 is brazed to the circumferential wall 72*a* of the condensation section outlet header section 72 of the left header section 63, and the distal end of the lower fixing portion 84 is brazed to the circumferential wall 76*a* of the super-cooling section inlet header section 76 of the left header section 63. An external thread 86 is formed on the outer circumferential surface of an upper end portion of the base member 81. An internal thread 87 for screw engagement with the external thread 86 of the base member 81 is formed on the inner circumferential surface of a lower end portion of the reservoir section main body 82. The lower end portion of the reservoir section main body 82 is screw-fitted onto the upper end portion of the base member 81, whereby the reservoir section main body 82 is detachably attached to the base member 81, and the lower end opening of the reservoir section main body 82 is closed by the base member 81.

A first communication section 85 establishes communication between a portion of the interior of the condensation section outlet header section 72 of the left header section 63, which portion is located below the vertically middle position thereof and near the lower end thereof, and a portion of the interior of the reservoir section 61, which portion is located above the lower end of the condensation section outlet header section 72. The first communication section 85 has a through hole 88 which is formed in the circumferential wall 72*a* of the condensation section outlet header section 72 of the left header section 63 at a position corresponding to the distal end of the upper fixing portion 83 of the base member 81, and a flow passage 89 which extends from the inner circumferential surface of the circumferential wall 81*a* of the base member 81 to the distal end of the upper fixing portion 83 and establishes communication between the through hole 88 of the left header section 63 and the interior of the base member 81. The opening of the flow passage 89 located on the side toward the circumferential wall 81*a* of the base member 81 serves as a refrigerant inflow opening 91 through which liquid-phase dominant refrigerant flows into the interior of the base member 81.

Also, a second communication section 92 establishes communication between a portion of the interior of the super-cooling section inlet header section 76 of the left header section 63, which portion is located above the vertically middle position thereof, and a portion of the interior of the reservoir section 61, which portion is located below the lower end of the condensation section outlet header section 72. The second communication section 92 has a through hole 93 which is formed in the circumferential wall 76*a* of the super-cooling section inlet header section 76 of the left header section 63 at a position corresponding to the distal end of the lower fixing portion 84, and a flow passage 94 which extends from the inner circumferential surface of the circumferential wall 81*a* of the base member 81 to the distal end of the lower fixing portion 84 and establishes communication between the through hole 93 of the left header section 63 and the interior of the base member 81.

A flow velocity reducing member 27 is provided in the base member 81 of the reservoir section 61. The flow velocity reducing member 27 reduces the flow velocity of liquid-phase dominant refrigerant which passes through the first communication section 85 and laterally flows into the interior of the base member 81 of the reservoir section 61. The flow velocity reducing member 27 is formed of a mesh-like material, and is boned to the right side of a vertically elongated rectangular support frame 28, which is formed of a synthetic resin and is disposed upright, such that the flow velocity reducing member 27 covers an opening surrounded by the support frame 28. The mesh-like material which constitutes the flow velocity reducing member 27 is identical to that used in the condenser 1 of the first embodiment. It is preferred that the size of the flow velocity reducing member 27 and the distance between the flow velocity reducing member 27 and the refrigerant inflow opening 26 be determined in the same manner as in the case of the condenser 1 of the first embodiment.

A foreign matter removal member 95 for removing foreign matter from refrigerant is disposed in the base member 81 of the reservoir section 61. The foreign matter removal member 95 includes a bottomed cylindrical frame member 96 which is formed of a synthetic resin, which is disposed such that its longitudinal direction coincides with the vertical direction and such that its upper end is located between the flow passage 89 of the upper fixing portion 83 and the flow passage 94 of the lower fixing portion 84, and which is open at the upper end thereof and is closed at the lower end thereof; and a mesh-like filter 98 which covers a plurality of communication openings 97 formed in the circumferential wall 96*a* of the frame member 96. A plate-shaped partition member 99 for dividing the interior of the reservoir section 61 into upper and lower sections is formed at the upper end of the circumferential wall 96*a* of the frame member 96. The support frame 28 of the flow velocity reducing member 27 formed of a mesh-like material is integrally formed at the right-side portion of the partition member 99.

A desiccant container 39 filled with a desiccant (not shown) is disposed in a region within the reservoir section 61 located above the flow velocity reducing member 27. The support frame 28 prevents the desiccant container 39 from coming into contact with the flow velocity reducing member 27.

The condenser 60 constitutes a refrigeration cycle in cooperation with a compressor, an expansion valve (pressure reducer), and an evaporator; and the refrigeration cycle is mounted on a vehicle as a car air conditioner.

In the condenser 60 having the above-described structure, gas phase refrigerant of high temperature and high pressure compressed by the compressor flows into the condensation section inlet header section 74 of the right header tank 64 through the refrigerant inlet member 78 and the refrigerant inlet. The gas phase refrigerant is condensed while flowing leftward within the heat exchange tubes 62 of the first heat exchange path P1, and the refrigerant flows into the left-side intermediate header section 71 of the left header tank 63. The refrigerant having flowed into the left-side intermediate header section 71 of the left header tank 63 is condensed while flowing rightward within the heat exchange tubes 62 of the second heat exchange path P2, and the refrigerant flows into the right-side intermediate header section 75 of the right header tank 64. The refrigerant is further condensed while flowing leftward within the heat exchange tubes 62 of the third heat exchange path P3, and flows into the condensation section outlet header section 72 of the left header tank 63. The refrigerant having flowed into the condensation section outlet header section 72 of the left header tank 63 passes through the through hole 88 and the flow passage 89, which constitute the first communication section 85, and laterally flows into the reservoir section 61 from the refrigerant inflow opening 91.

Since the liquid-phase dominant refrigerant having flowed into the reservoir section 61 in the lateral direction passes through the flow velocity reducing member 27, its flow velocity is reduced. The liquid-phase dominant refrigerant having a reduced flow velocity flows downward due to gravity, and the gas-phase refrigerant which is contained in the liquid-phase dominant refrigerant in the form of bubbles also flows downward together with the liquid-phase dominant refrigerant. The liquid-phase dominant refrigerant containing the gas-phase refrigerant in the form of bubbles and having flowed downward enters the super-cooling section inlet header section 76 through the upper end opening of the frame member 96 of the foreign matter removal member 95, the communication openings 97, and the flow passage 94 and the through hole 93, which constitute the second communication section 84. Accordingly, a portion of the interior of the reservoir section 61, which portion is located above the center (with respect to the vertical direction) of the refrigerant outflow opening 91 of the flow passage 89 of the first communication section 85, is quickly filled with liquid-phase refrigerant. As a result, the range of the refrigerant charge amount corresponding to the stable range S which is indicated on the charge graph shown in FIG. 11 and within which the degree of super-cooling becomes constant can be made wider than that in the case of the condenser described in the above-mentioned publication. Thus, a super-cooling characteristic which is stable against change in load and leakage of refrigerant can be obtained.

The refrigerant having flowed into the super-cooling section inlet header section 76 enters the heat exchange tubes 62 of the fourth heat exchange path P4, and is super-cooled, while flowing rightward within the heat exchange tubes 62. After that, the refrigerant enters the super-cooling section outlet header section 77 of the right header tank 64, and flows out through the refrigerant outlet and the refrigerant outlet member 79. The refrigerant is then fed to the evaporator via the expansion valve.

Notably, a guide 51 similar to the guide 51 of the condenser 50 of the second embodiment may be provided in the reservoir section 61 of the condenser 60 of the above-described third embodiment so as to guide downward the liquid-phase dominant refrigerant having passed through the first communication section 85 and laterally flowed into the reservoir section 61. Also, the number of the heat exchange paths of the condensation section 60A of the condenser 60 of the above-described third embodiment and the number of the heat exchange paths of the super-cooling section 60B thereof are not limited to the above-mentioned numbers.

According to the embodiment, the flow velocity reducing member which reduces the flow velocity of the liquid-phase dominant refrigerant which passes through the communication section and flows into the reservoir section is provided in the reservoir section at a vertical position corresponding to the end portion of the communication section located on the side toward the reservoir section. Therefore, the flow velocity of the liquid-phase dominant refrigerant which passes through the communication section and flows into the reservoir section is reduced, whereby the liquid-phase dominant refrigerant becomes more likely to flow downward due to gravity. Accordingly, gas-phase refrigerant which is contained in the liquid-phase dominant refrigerant in the form of bubbles also moves downward together with the liquid-phase dominant refrigerant, whereby a portion of the interior of the reservoir section, which portion is located above the center (with respect to the vertical direction) of the communication section, is quickly filled with liquid-phase refrigerant. As a result, the range of the refrigerant charge amount corresponding to the stable range S which is indicated on the charge graph shown in FIG. 11 and within which the degree of super-cooling becomes constant can be made wider than that in the case of the condenser described in the above-mentioned publication. Thus, a super-cooling characteristic which is stable against change in load and leakage of refrigerant can be obtained.

According to the embodiment, it is possible to finely divide the gas-phase refrigerant, while reducing the flow velocity of the liquid-phase dominant refrigerant which passes through the communication section and flows into the reservoir section. Thus, it becomes easier for the gas-phase refrigerant to mix with the liquid-phase dominant refrigerant, whereby the gas-phase refrigerant becomes more likely to be led downward together with the liquid-phase dominant refrigerant which flows downward due to gravity.

According to the embodiment, the support frame of the flow velocity reducing member and the frame member of the foreign matter removal member are integrally formed or assembled together to form an assembly. Therefore, a work for disposing the flow velocity reducing member and the foreign matter removal member in the reservoir section becomes easier.

According to the embodiment, the liquid-phase dominant refrigerant which passes through the refrigerant inflow opening and laterally flows into the reservoir section is guided downward, whereby the liquid-phase dominant refrigerant is forcedly moved downward. As a result of this, coupled with the reduction of the flow velocity by the flow velocity reducing member, the gas-phase refrigerant which is contained in the liquid-phase dominant refrigerant in the form of bubbles is also moved downward effectively, together with the liquid-phase dominant refrigerant, whereby a portion of the interior of the reservoir section, which portion is located above the center (with respect to the vertical direction) of the communication section, is quickly filled with liquid-phase refrigerant. As a result, the range of the refrigerant charge amount corresponding to the stable range S which is indicated on the charge graph shown in FIG. 11 and within which the degree of super-cooling becomes constant can be made wider than that in the case of the condenser described in the above-mentioned publication. Thus, a super-cooling characteristic which is stable against change in load and leakage of refrigerant can be obtained.

According to the embodiment, it is possible to prevent the desiccant disposed within the reservoir section from hindering the action of the flow velocity reducing member.

According to the embodiment, the length of the heat exchange tubes of all the heat exchange paths of the super-cooling section becomes greater than the length of the heat exchange tubes of all the heat exchange paths of the condensation section. Therefore, the area of the heat exchange section increases as compared with the condenser described in the above-mentioned publication, whereby the condenser has an increased refrigerant super-cooling efficiency.

According to the embodiment, the flow velocity of the greater part of the liquid-phase dominant refrigerant which passes through the communication section and flows into the reservoir section can be reduced by the flow velocity reducing member.

According to the embodiment, the flow velocity of the liquid-phase dominant refrigerant which passes through the communication section and flows into the reservoir section can be reduced effectively by the flow velocity reducing member.

Obviously, numerous modifications and variations of the present invention are possible in light of the above teachings. It is therefore to be understood that within the scope of the appended claims, the invention may be practiced otherwise than as specifically described herein.

What is claimed is:

1. A condenser comprising:

a first header tank which is provided on one side of the condenser;

a second header tank provided on the one side of the condenser and having a gas-liquid separation function, an upper end of the second header tank being located above a lower end of the first header tank;

a third header tank provided on another side of the condenser opposite to the one side;

a plurality of short heat exchange tubes extending in an extending direction between the first header tank and the third header tank to connect the first header tank and the third header tank;

a plurality of long heat exchange tubes provided below the plurality of short heat exchange tubes and extending in the extending direction between the second header tank and the third header tank to connect the second header tank and the third header tank without being connected to the first header tank, the plurality of long heat exchange tubes being longer than the plurality of short heat exchange tubes in the extending direction, the plurality of long heat exchange tubes being inserted into the second header tank to have tube ends of the long heat exchange tubes in the second header tank and to have an inside length in the extending direction from the tube ends of the long heat exchange tubes to an inner surface of the second header tank;

a communication section directly connecting the first header tank and the second header tank, the first header tank directly connecting plurality of short heat exchange tubes and the communication section, the communication section having a first end portion and a second end portion opposite to the first end portion, the first end portion being brazed to the first header tank, the second end portion being brazed to the second header tank; and a flow velocity reducing member provided in the second header tank to face the second end portion of the communication section, a distance in the extending direction from the second end portion of the communication section to the flow velocity reducing member being smaller than the inside length in the extending direction of the long heat exchange tubes.

2. The condenser according to claim 1, wherein the flow velocity reducing member is made of a mesh material.

3. The condenser according to claim 2, further comprising:

a foreign matter removal member provided in the second header tank downstream the flow velocity reducing member.

4. The condenser according to claim 3, further comprising:

a support frame holding the mesh material, wherein the foreign matter removal member comprises a frame member having a communication opening through which refrigerant passes, and a filter covering the communication opening; and wherein the support frame of the flow velocity reducing member and the frame member of the foreign matter removal member are integrally formed or assembled together to form an assembly.

5. The condenser according to claim 2, wherein the mesh material has an opening size of 160 μm or less and an opening ratio of 50% or less.

6. The condenser according to claim 1, further comprising:

a desiccant provided in the second header tank such that the desiccant does not interfere with the flow velocity reducing member.

7. The condenser according to claim 1, wherein the first header tank and the second header tank are positionally shifted from each other.

8. The condenser according to claim 1, wherein the refrigerant is to flow into the third header tank from an outside of the condenser.

9. The condenser according to claim 1, wherein the flow velocity reducing member has a plate shape and is supported by a rectangular frame.

10. The condenser according to claim 1, wherein the first header tank has a first through hole, wherein the second header tank has a second through hole one end of which faces the first through hole and an opposite end of which faces the flow velocity reducing member, and wherein the communication section has a communication member brazed to the first header tank and the second header tank to connect the first through hole and the second through hole.

* * * * *